US005426569A

United States Patent [19]

Sopori

[11] Patent Number: 5,426,569

[45] Date of Patent: Jun. 20, 1995

[54] METHOD AND APPARATUS FOR SIMULATING ATOMOSPHERIC ABSORPTION OF SOLAR ENERGY DUE TO WATER VAPOR AND $CO_2$

[75] Inventor: Bhushan L. Sopori, Denver, Colo.

[73] Assignee: Midwest Research Institute, Kansas City, Mo.

[21] Appl. No.: 206,933

[22] Filed: Mar. 7, 1994

[51] Int. Cl.[6] ..... F21V 9/04

[52] U.S. Cl. ..... 362/2; 362/32; 362/96; 362/293; 362/299; 362/301; 362/346; 250/504 R; 359/358

[58] Field of Search ..... 250/493.1, 504 R; 359/350, 358; 372/11; 385/900; 362/1, 2, 32, 267, 293, 294, 96, 298, 299, 300, 301, 346

[56] References Cited

U.S. PATENT DOCUMENTS

| | | | |
|---|---|---|---|
| H229 | 3/1987 | Phillips | 165/96 |
| 1,565,590 | 12/1925 | Ritterrath | 359/358 |
| 1,827,530 | 10/1931 | Grand | 600/21 |
| 3,171,027 | 2/1965 | Wallack | 359/358 |
| 3,334,217 | 8/1967 | Bickler et al. | 362/2 |
| 3,388,314 | 6/1968 | Gould | 250/493.1 |
| 3,870,873 | 3/1975 | Mallory | 362/2 |
| 4,641,227 | 2/1987 | Kusuhara | 362/2 |
| 4,789,989 | 12/1988 | Stern et al. | 362/32 |
| 5,217,285 | 6/1993 | Sopori | 362/1 |
| 5,250,258 | 10/1993 | Oh | 250/504 R |

*Primary Examiner*—Ira S. Lazarus
*Assistant Examiner*—Alan B. Cariaso
*Attorney, Agent, or Firm*—Edna M. O'Connor

[57] ABSTRACT

A method and apparatus for improving the accuracy of the simulation of sunlight reaching the earth's surface includes a relatively small heated chamber having an optical inlet and an optical outlet, the chamber having a cavity that can be filled with a heated stream of $CO_2$ and water vapor. A simulated beam comprising infrared and near infrared light can be directed through the chamber cavity containing the $CO_2$ and water vapor, whereby the spectral characteristics of the beam are altered so that the output beam from the chamber contains wavelength bands that accurately replicate atmospheric absorption of solar energy due to atmospheric $CO_2$ and moisture.

23 Claims, 6 Drawing Sheets

METHOD AND APPARATUS FOR SIMULATING ATOMOSPHERIC ABSORPTION OF SOLAR ENERGY DUE TO WATER VAPOR AND $CO_2$

CONTRACTUAL ORIGIN OF THE INVENTION

The United states Government has rights in this invention under contract No. DE-AC02-83CH10093 between the United States Department of Energy and the National Renewable Energy Laboratory, A Division of the Midwest Research Institute.

BACKGROUND OF THE INVENTION

1. Field of the Invention

The present invention relates to methods and devices for simulating the spectral characteristics of solar terrestrial radiation, and more particularly to a method and apparatus that can replicate absorption of solar energy due to atmospheric $CO_2$ and water vapor.

2. Description of the Prior Art

Since terrestrial solar cells are designed to efficiently operate under solar energy at the earth's surface, it is of great importance for fabricators, researchers, and developers to be able to test solar cells under artificially created light that has spectral characteristics that closely match those of sunlight reaching earth. Accordingly, several standardized solar spectra have been developed for sunlight in various places and conditions. The standard reference spectrum for extra-terrestrial sunlight is referred to as the AM0 spectrum. Similarly, the AM1.5 spectrum identifies the solar spectrum on an average sunny day, while the AM2 spectrum designates the solar spectrum found on the surface of the earth at sea level. To test solar cells designed to work on earth the AM1.5 or AM2 spectra should be used, and simulator systems have been developed that produce output beams that approximate these standard spectra.

Recent advances in solar cell technology, including the development of advanced multi-junction devices, have increased cell efficiencies to near theoretical limits. This in turn, has required improved, more accurate solar simulators. U.S. Pat. No. 5,217,285 discloses such an advanced simulator which, among other things, can be adjusted to produce a uniformly distributed test beam that is well-matched to a given standard solar spectrum, such as Global AM0, AM1.5 or AM2. A comparison is made in FIG. 1. between the standard AM0 spectrum and a AM0 spectrum that is simulated by a simulator according to U.S. Pat. No. 5,217,285, and an extremely good match between the two spectra is revealed. FIG. 2 shows that such an advanced device can also produce a replication of the standard Global AM1.5 terrestrial spectrum. This replication is seen to be a very good match in the sense of comprising an envelope to the standard Global AM1.5 spectrum, however it is evident that it does not include certain absorption bands occurring above the 0.7 nm wavelength, in the near infrared and infrared region. Atmospheric water vapor and $CO_2$ absorb solar radiation in quite specific wavelength bands in the IR region, and consequently the spectral distribution of terrestrial radiation as shown in FIG. 2. in the standard Global AM1.5 spectrum contains several pronounced dips. Note that these wavelength bands are attributable primarily to atmospheric water vapor, and to $CO_2$ to a minor extent, and of the atmospheric gases such as $N_2$, $O_2$ and CO, $CO_2$ is the most significant light-absorbing gas.

In order to adjust a simulated terrestrial beam for atmospheric water vapor, the conventional approach has been to use water filters. This has not been successful, primarily because the liquid phase of water has very broad absorption bands that do no replicate absorption due to atmospheric water vapor. This can be seen from FIG. 3 which shows the absorption spectrum of an 8 cm thick water column. An additional drawback of the water filter approach is that unwanted absorption and changes in a simulated solar beam are produced over the entire spectral range when the beam passes through a water medium.

SUMMARY OF THE INVENTION

In view of the aforestated drawbacks and limitations of the prior art, it is a general object of the present invention to provide for a more accurate simulation of a given standard terrestrial solar spectrum.

A more particular object is to provide a simulated solar spectrum that includes a replication of absorption bands due to atmospheric moisture and $CO_2$.

Another object of the invention is to provide an optical filtering device of compact dimensions, convenient for laboratory bench use.

Yet another object of the invention is to provide an optical filter that simulates the effects of the passage of light through the entire thickness of the earth's atmosphere, yet which achieves such replication with a simulated beam path that is relatively very small, in the order of 1 meter or less.

A still further object is to provide such a method and apparatus that takes advantage of the "evanescent coupling effect" to replicate atmospheric absorption of solar radiation due to $CO_2$ and water vapor.

An additional object is to provide for the elimination of performance measurement errors, caused by spectral mismatch, in testing new advanced and highly efficient multi-junction cells.

To achieve the aforestated objects and advantages, an optical filter according to the present invention includes a chamber having walls that define an internal cavity for holding a hot vaporous mixture of $CO_2$ and water vapor, the chamber having an inlet and an outlet for the vaporous mixture, as well as an optical inlet and outlet. The invention includes means for generating a stream of $CO_2$ and water vapor, and for raising the temperature of the stream to about 70° to 90° C., whereby the vaporous mixture has a relative humidity in a range of about 70% to 90%. There is also means for delivering the stream to the chamber via the inlet in a manner effective to fill the chamber with the vaporous mixture and to maintain a certain mass of the mixture within the cavity while excess mixture flows out of the inlet. There are heating means for the chamber and the generator that are controlled to ensure that the vaporous contents of the chamber cavity are maintained at the desired temperature, and to prevent unwanted condensation within the chamber.

In one preferred embodiment, the inventive filter device is adapted to pass an essentially IR beam in a path directly from the optical inlet of the chamber, through the heated vaporous contents of the chamber, and out of the chamber optical outlet. Unexpectedly, the high relative humidity environment did not act like liquid water and cause undesirable spectral distortions, and replications of wave bands due to atmospheric absorption by water vapor and $CO_2$ could be achieved using a beam path less than 1 meter.

There are other embodiments of the invention that employ reflective optical elements within the chamber for directing an input beam through multiple reflections before it exits the chamber optical outlet, such configurations extending the beam path and permitting chambers of even smaller, compact dimensions. In one preferred embodiment, the chamber has a generally spherical reflective interior surface, and a reflective element, such as a concave mirror, is disposed within the chamber so as to intercept an incoming beam and reflect it onto the spherical surface, causing multiple reflections. In yet another embodiment of the invention a quartz fiber rod is disposed within the chamber, opposite ends of the rod comprising respectively, the optical inlet and optical outlet of the chamber, and the envelope of $CO_2$ and water vapor, having a refractive index less than quartz, providing for evanescent coupling with light that is internally reflected at the walls of the rod, this coupling effect being sufficient to provide the desired simulation of atmospheric absorption due to $CO_2$ and water vapor.

BRIEF DESCRIPTION OF THE DRAWINGS

The accompanying drawings, which are incorporated in and form a part of the specification, illustrate preferred embodiments of the present invention and together with the description serve to explain the principles of the invention, wherein.

DETAILED DESCRIPTION OF THE INVENTION

Figure 5:
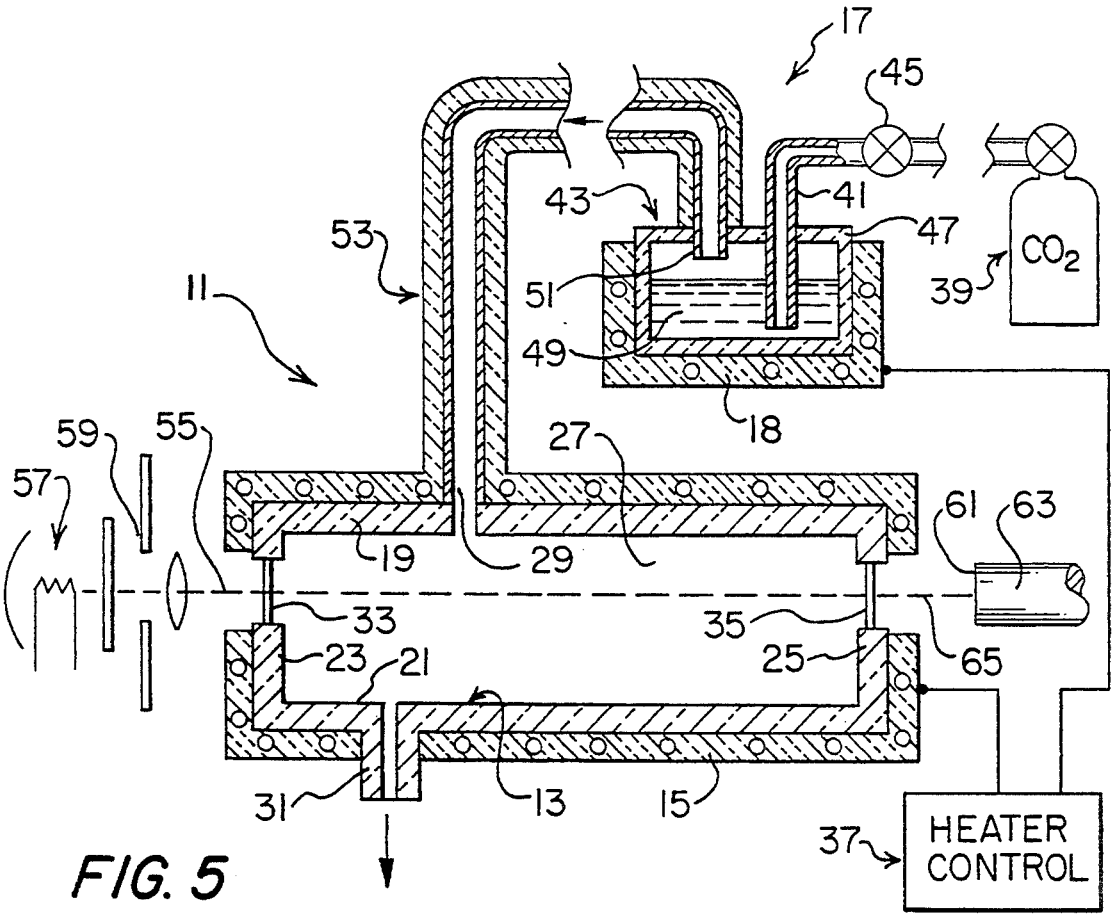
FIG. 5 is a schematic illustration showing a preferred embodiment of an optical filter apparatus according to the present invention.

Referring now to the drawings, FIG. 5 shows that a preferred embodiment of a water vapor and $CO_2$ filter 11 according to the present invention, includes a chamber 13, a chamber heater 15, and a $CO_2$ and water vapor generator 17, including heater 18.

Chamber 13 has a generally tubular glass construction and includes an upper wall 19, lower wall 21, a front wall 23 and a rear wall 25, which walls' interior define a cavity 27. There is an inlet 29 in the chamber upper wall 19 for admitting $CO_2$ and water vapor to the cavity 27, and an outlet 31 for the vaporous mixture is located in the chamber lower wall 21. A quartz or glass window 33 is mounted, with a suitable fluid-tight seal, in the chamber front wall 23, and serves as an optical inlet. An optical outlet is provided by a quartz or glass window 35 that is similarly mounted in chamber wall 25, opposite the window 33.

The chamber heater 15 is a conventional resistance coil-type assembly that wraps around the walls of chamber 13, and includes a jacket of a suitable insulation material. Heater 15 is connected to conventional heat control 37, and is capable of heating chamber 13 and the contents of cavity 27 in a manner that will be described hereinafter.

FIG. 5 shows that the generator 17 includes, as a $CO_2$ source, a canister 39 of pressurized $CO_2$ which is connected to the inlet 41 of a conventional bubbler 43 by way of a flow meter and regulator 45. A bubbler reservoir 47 contains water 49, and a bubbler outlet 51 is connected via an insulated conduit 53 to the chamber inlet 29. The exterior of the bubbler reservoir 47 is embraced by heater 18 which comprises a conventional insulation-jacketed resistance coil that is regulated by the heater control 37.

When filter device 11 is used in conjunction with a solar simulator, it is positioned so that a selected input beam 55 can be projected, preferably as a relatively narrow well-collimated beam, into window 33 and out of window 35. Filter 11 is particularly advantageous when incorporated in an advanced system, such as disclosed in U.S. Pat. No. 5,217,285, for replicating desired standard terrestrial solar spectra, but which spectra do not include accurate replications of absorption bands due to atmospheric water vapor and $CO_2$. U.S. Pat. No. 5,217,285, which is incorporated herein by reference, employs a randomized trifurcated fiber optic cable that produces a uniform output beam that is a substantially homogeneous mix of light from three beams. A first beam of visible wavelengths is carried by a first leg of the trifurcated cable, ultraviolet light by a second leg, and infrared and near infrared light (IR) by a third leg. It is in association with the IR leg of such a system that the present invention can be used.

The input beam 55, shown in FIG. 5, is obtained from a tungsten filament lamp 57, and has wavelengths and intensities that very closely approximate those produced by a sun in the near infrared and infrared regions. A variable aperture 59 can selectively regulate the intensity of the input beam 55. The input end 61 of cable leg 63 is disposed adjacent window 35 so as to receive the output beam 65 of device 11.

To render device 11 operative it is required to fill cavity 27 with a water vapor and $CO_2$ mixture supplied by generator 17, and maintain the mixture within chamber 13 at a desired temperature and relative humidity. Accordingly, the bubbler 43 is made ready by raising the temperature of water 49 using heater 18 and control 37. Then $CO_2$ from canister 39 is flowed through the heated water as the flow is controlled at a desirable level, less than 5 liters/min, and preferably about 2 liters/min. Thus bubbler 43 produces a stream comprising a mixture of $CO_2$ and water vapor, and having a relative humidity preferably in the range of about 70–100%, preferably about 90%, in the range of 70° C. to 90° C., preferably to and a temperature of about 90° C. The insulated conduit 53 delivers this mixture to the chamber inlet 29. Thus cavity 27 is filled with the $CO_2$ and water vapor mixture, outflow of the mixture occurring through the outlet 31 which ensures that the operation occurs at essentially atmospheric pressure conditions. During this time the heater 15, controlled by control 37, is used to heat chamber 13 and its contents to ensure that the vaporous mixture is maintained at the desired temperature and relative humidity. The temperature of the mixture entering inlet 29 and the temperature of the chamber 13 are controlled such that condensation on interior surfaces of chamber 13 is avoided.

Figure 1:
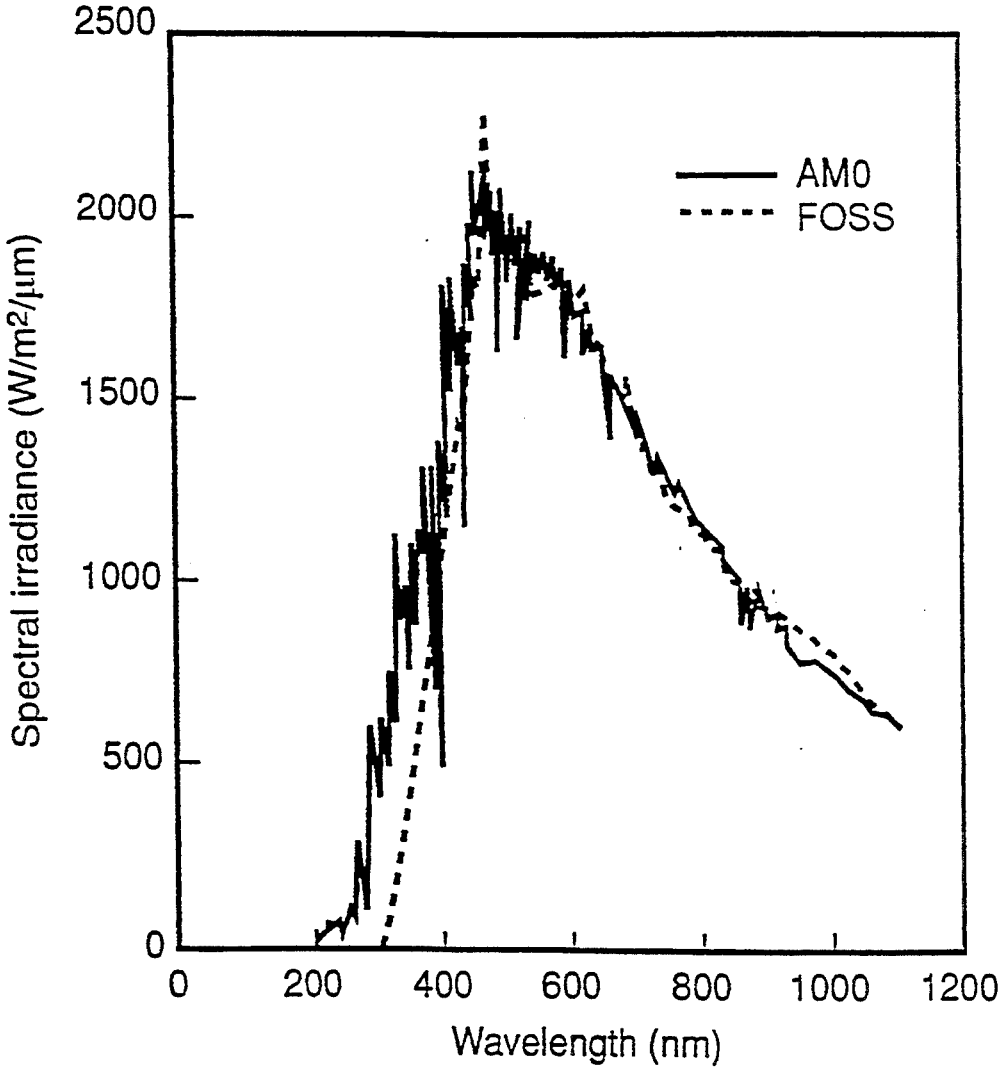
FIG. 1 is a graphical representation comparing the spectrum of the output beam of an advanced fiber optic simulator with the standard solar AM0 spectrum.
Figure 2:
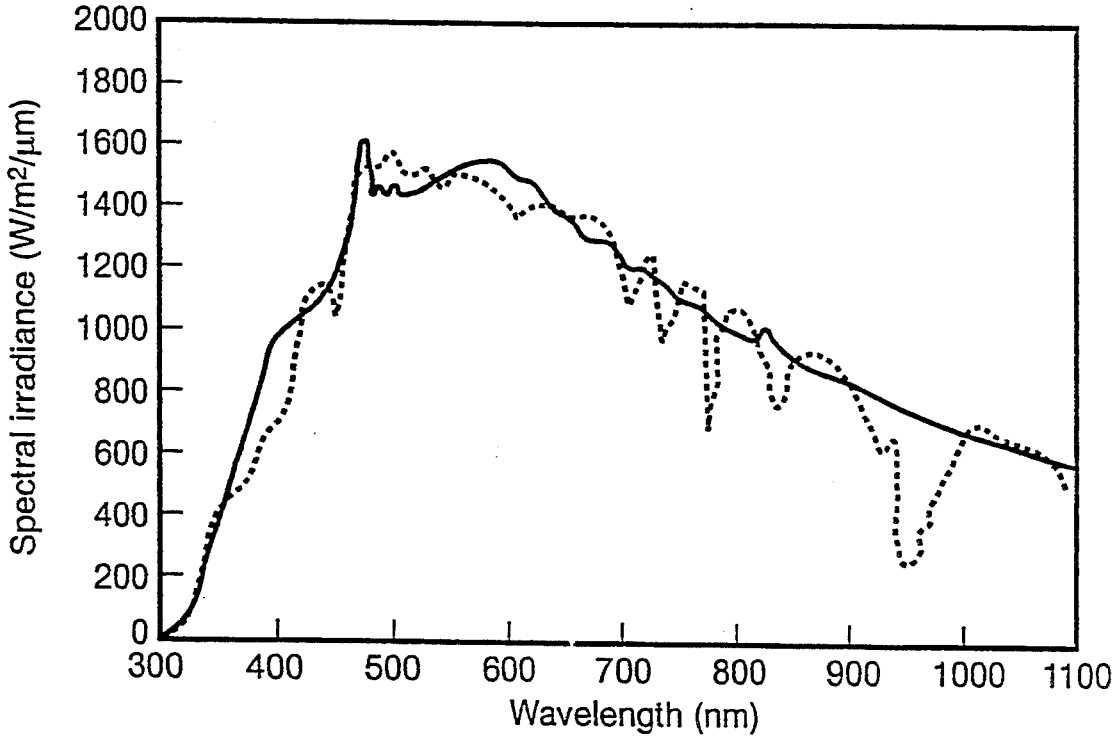
FIG. 2 is a graphical representation comparing the spectrum of the output beam of an advanced fiber optic solar simulator with the standard AM1.5 global spectrum.
Figure 3:
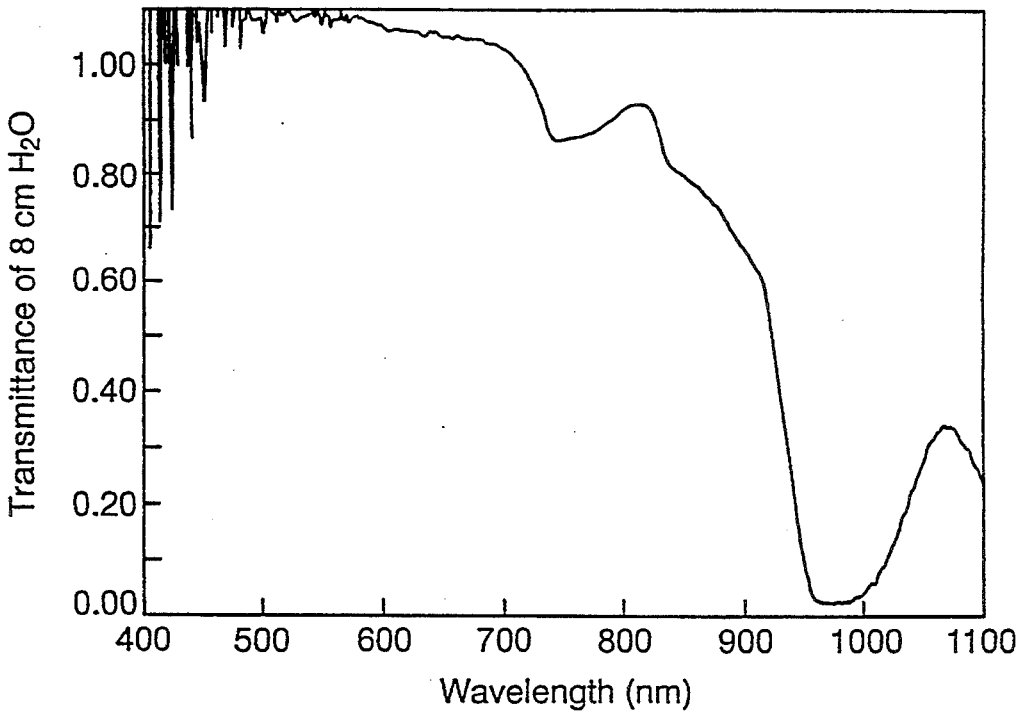
FIG. 3 is a graphical illustration of the transmittance spectrum of an 8 cm column of water.
Figure 4:
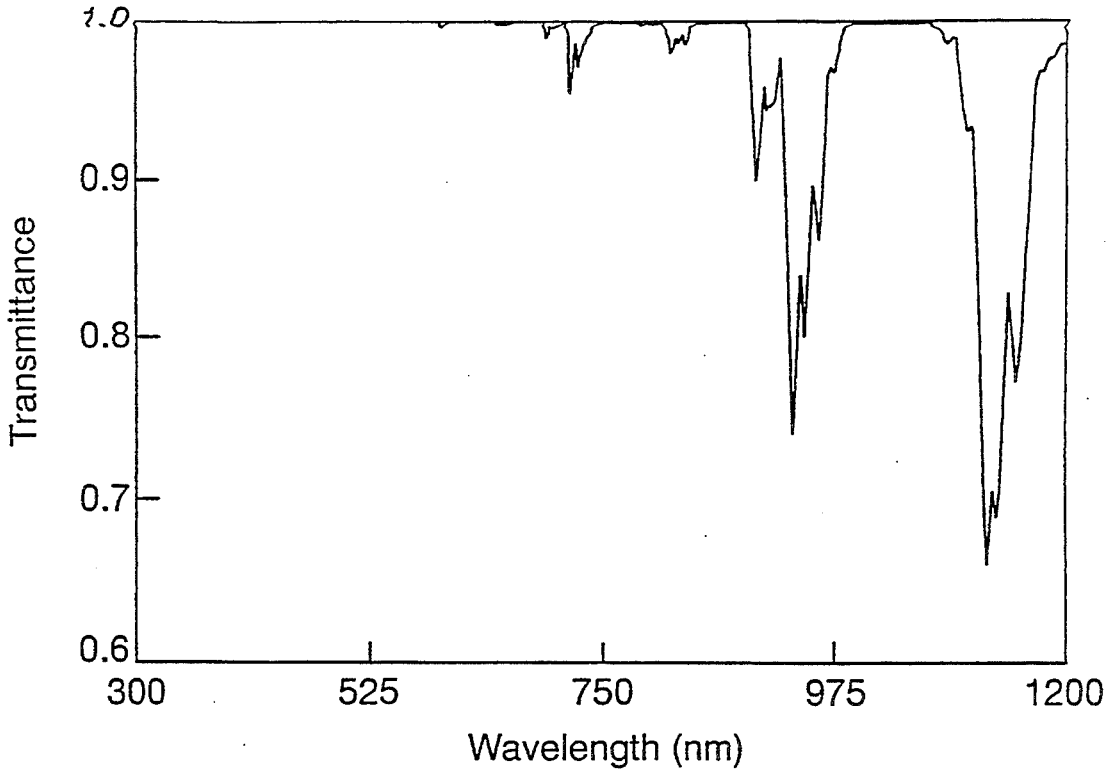
FIG. 4 is a graphical representation of a normalized transmittance spectrum for 1 m of water vapor at 90° C.

Device 11 can now be operated as an optical filter for the input beam 55 that follows a path through the cavity 27 mixture that is surprisingly short, yet sufficient to provide the output beam 65 with a spectrum that contains an accurate replication of wave bands due to atmospheric absorption due to $CO_2$ and water vapor. A primary advantage of this first embodiment 11 is that no reflective elements for extending the beam path through the chamber cavity are required, a straight path of about 1 meter or less sufficing to achieve the desired spectral change. The graphical representation of FIG. 4, which depicts the normalized transmittance spectrum of 1 meter of water vapor at 90° C., is indicative of the relatively narrow absorption peaks that are characteristic of the absorption bands found in the IR region of the standard Global AM 1.5 solar spectrum, and which are achievable by the present invention.

Figure 6:
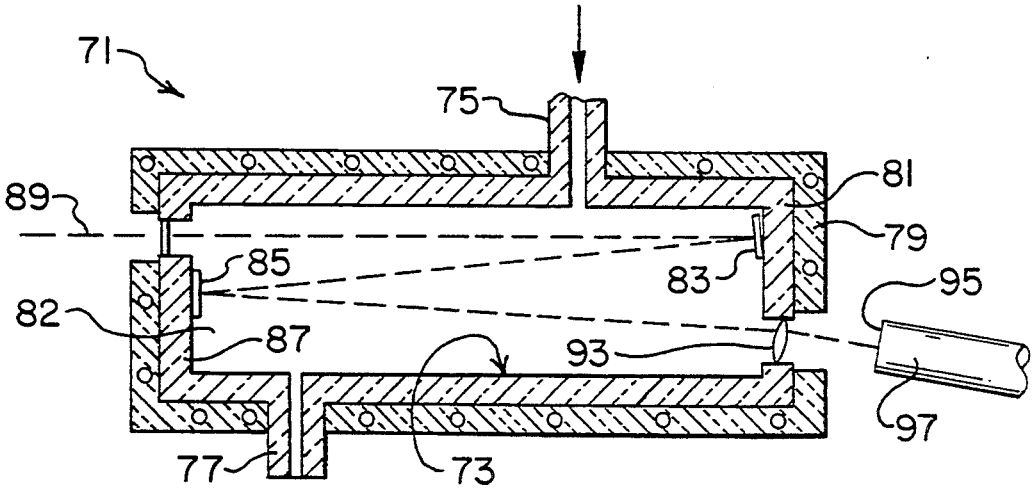
FIG. 6 is a schematic illustration of a second embodiment of an optical filter according to the present invention.

FIG. 6 illustrates a second embodiment 71 according to the present invention. This embodiment 71 includes a chamber 73 similarly constructed to that of the first embodiment 11, with an inlet 75 and outlet 77, and an insulated heater 79. Also like the first embodiment described above, embodiment 71 has, not shown, a $CO_2$ and water vapor generator connected to the inlet 75, and a control system for the generator and chamber heaters. The primary advantage of embodiment 71 is that it employs reflective elements to extend the length of the beam path in the chamber cavity 82, thereby making possible a shorter, more compact chamber. Accordingly a first mirror 83 is mounted in the chamber rear wall 81, and a second mirror 85 is mounted in front wall 87. As FIG. 6 illustrates, the mirrors 83 and 85 are oriented such that an input beam 89 through window 91 is directed along a Z-shaped path through cavity 82. A convex collimating lens 93 is mounted in a vapor-tight manner in the chamber rear wall 81 and is appropriately oriented to collect the internally reflected beam and focus it upon the input end 95 of optical fiber cable 97.

Variants of the embodiment 71 of the invention are contemplated which have only one mirror, or which use more mirrors than used in embodiment 71. In embodiments as described involving reflective elements for extending the effective beam path, one or more of these elements can be concavular to correct any undesirable beam divergence, such as can occur due to "thermal blooming" of a beam in a hot humid medium. Optical losses increase with beam length and the number of reflectors, and tend to decrease the intensity of the output beam, however it is to be appreciated that in such cases where the intensity of the input beam can be independently controlled, the input beam intensity is increased to increase the intensity of the output beam without altering the spectral distribution of the output beam.

Figure 7:
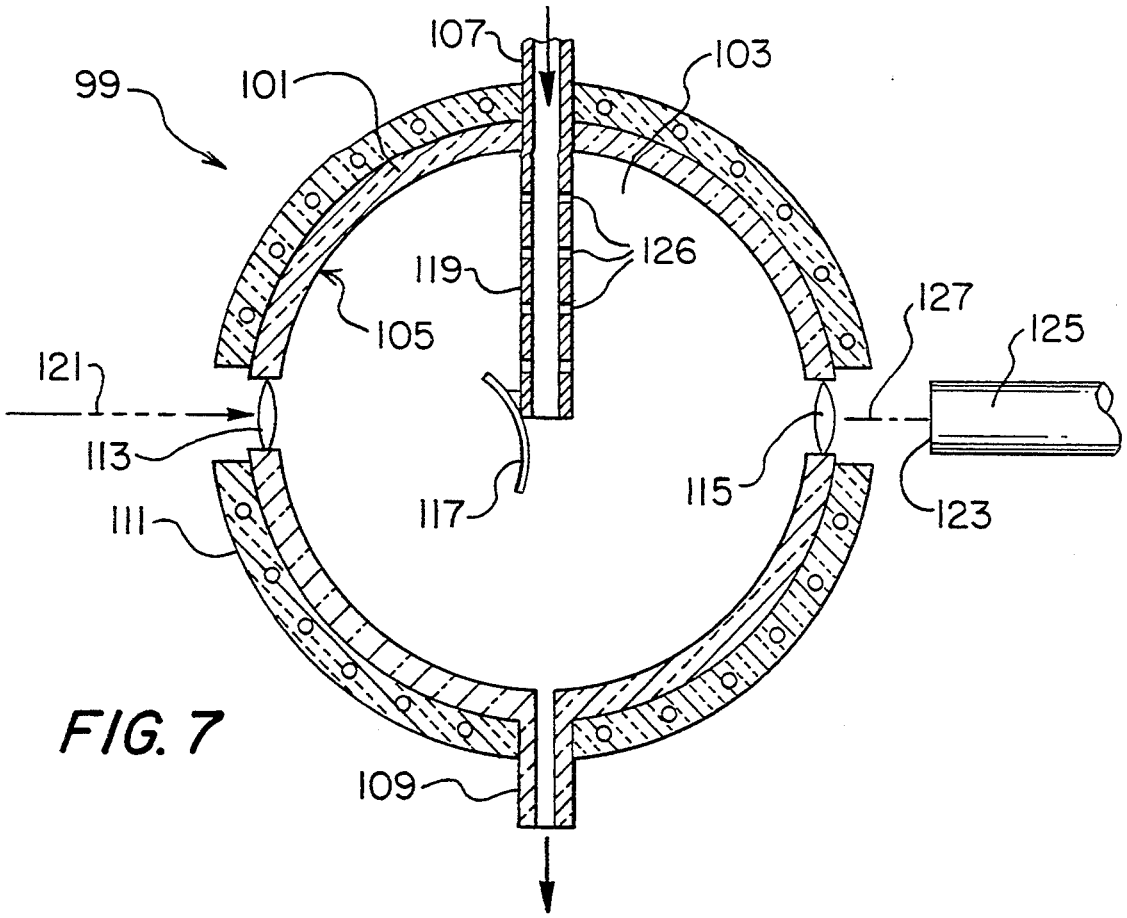
FIG. 7 is a schematic illustration of a third embodiment of an optical filer according to the present invention.

FIG. 7 illustrates a third embodiment 99 according to the present invention that features a chamber 101 having a cavity 103 that features a spherical reflective surface 105. There is a chamber inlet 107 at the top of chamber 101 and an outlet 109 at the lower part of the chamber 101, inlet 107 being connected in flow communication with a $CO_2$ and water vapor generator that is similarly constructed to the generator 17 described above with respect to the first embodiment 11. An insulated heater 111 is suitably arranged around the exterior of chamber 101 so as to effectively heat the chamber 101 and its vaporous contents. Suitable temperature control means, (not shown), control the temperature of $CO_2$ and the water vapor supplied to inlet 107, and the temperature of chamber 101. FIG. 7 shows that the optical inlet to chamber 101 comprises a convex lens 113 which is mounted in the chamber wall in a fluid-tight manner. The optical outlet comprises another convex lens 115 similarly mounted in an opposite wall of chamber 101. A concave mirror 117 is supported by support arm 119 near the optical center of the spherical reflective surface 81, such that lens 115 focuses an input beam 121 onto mirror 117 which reflects the beam in a diverging manner to strike a segment of the spherical reflective surface 105. This optical configuration is designed to result in multiple reflections off surface 105, which multiple reflections are collected by the output lens 115 which then focuses the collected rays to the input end 123 of fiber cable 125. Note that the mirror support arm 119 has a hollow construction marked with a plurality of orifices 126 which allow support 119 to serve as a manifold for distributing $CO_2$ and water vapor in the cavity 103. This third embodiment 99, by virtue of providing multiple reflections, can also have a chamber that is small, compact and conveniently insertable in a solar simulator. Such embodiments as embodiment 99 can have a chamber diameter as small as about 20 cm. As in the example of the second embodiment 71 and its variants, the intensity of the input beam 121 to embodiment 99 can be increased to provide the desired intensity level of output beam 127.

Figure 8:
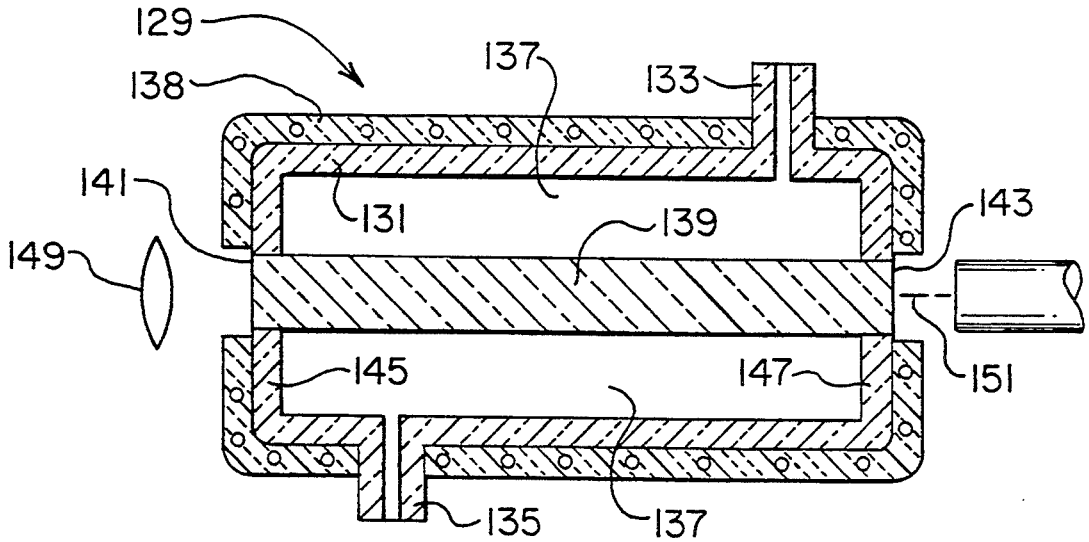
FIG. 8 is a schematic illustration of a fourth embodiment of an optical filter according to the present invention.

A fourth embodiment 129 according to the invention is illustrated in FIG. 8. Here shown is a cylindrical chamber 131 having a fluid inlet 133, fluid outlet 135, and cavity 137. An insulated heater 138 embraces the outside of chamber 131. As in the other embodiments of the invention, this embodiment includes appropriate means (not shown) for supplying the inlet 133 with a heated stream of $CO_2$ and water vapor. Embodiment 129 features a relatively thick quartz optical fiber rod 139 which is disposed along the axis of chamber 131, and which has an input end 141 and an output end 143 which serve respectively as the optical inlet and optical outlet for the chamber 131. Note that respective end portions of the rod 139 are sealed in a fluid-tight manner to opposite chamber end walls 145 and 147. A convex lens 149 is positioned so as to focus an input beam onto the rod input end 141. A unique aspect of embodiment 129 is that it takes advantage of the evanescent coupling that effects light beams in rod 139 that are incident at the interface of the quartz rod and an envelope of heated $CO_2$ and water vapor. It is significant that the $CO_2$ and water vapor mixture is a less dense light transmitting medium than quartz, and has a lower refractive index. Due to the evanescent coupling of the light beams internally reflected at the walls of rod 139, absorption of the light will effectively occur, so as to produce an output beam 151 that simulates the desired spectral wave bands due to atmospheric $CO_2$ and water vapor. Note that due to the three-dimensional nature of light within rod 139, and its reflection, the effective optical path is much greater than the physical length of rod 139. A particular advantage of this fourth embodiment 129 is that no mirrors are needed, and light coupling to and from the ends of rod the ends of 139 can be easily done.

While a number of specific optical and mechanical components were described above with respect to the first, second, third and fourth embodiments, persons skilled in this art, given the benefit of this disclosure, will readily recognize that other substitute components may be available now and in the future to accomplish comparable functions to make simulations of atmospheric absorption due to $CO_2$ and water vapor according to this invention.

Thus the foregoing is considered as illustrative only of the principles of the invention. Further, since numerous modifications and changes may readily occur to those skilled in the art, it is not desired to limit the invention to the exact construction and operation as shown and described, and accordingly all suitable modifications and equivalents may be resorted to within the scope of the invention as defined by the claims which follow except as precluded by the prior art.

The embodiments in which an exclusive property or privilege is claimed are defined as follows:

1. A method for replicating the absorption wavelength bands contained in a standard solar terrestrial spectrum that are due to absorption of sunlight by atmospheric $CO_2$ and water vapor, said method including the steps of:

a. providing a chamber having an optical inlet and optical outlet, and a cavity;

b. providing an input beam that simulates a standard solar terrestrial spectrum, with the exception of characteristic absorption bands due to atmospheric $CO_2$ and water vapor;

c. filling said chamber cavity with a mixture of $CO_2$ and water vapor, and maintaining said mixture at a relative humidity in the range of about 70% to 90% and at a temperature in the range of about 70° C. to 90° C.; and d. transmitting said input beam along a path through said mixture by way of said optical inlet and outlet, whereby said characteristic absorption bands are replicated in the beam at said optical outlet.

2. A method as defined in claim 1 wherein said input beam is a simulated beam of infrared and near infrared light.

3. A method as defined in claim 1 wherein said beam path is about 1 meter long or less.

4. A method as defined in claim 1 wherein said mixture is held at about atmospheric pressure.

5. A method as defined in claim 1 wherein said mixture is preheated to about 90° C. before said mixture fills said cavity and wherein said chamber is heated to maintain the temperature of said mixture filling said cavity.

6. A method as defined in claim 1 including employing at least one reflective optical element within said chamber for causing said beam path to have at least one reflection.

7. A method as defined in claim 6 including the step of providing said beam path with a plurality of reflections.

8. A method as defined in claim 6 wherein said chamber has an effective length, and said beam path is a plurality of times longer than said effective length.

9. A method as defined in claim 1 including providing said chamber with an internal spherical reflective surface, and projecting said input beam onto said spherical surface to cause multiple reflections of said beam within said cavity, and collecting said reflected beam at said chamber optical outlet.

10. A method as defined in claim 1 wherein said optical inlet and optical outlet comprise opposite ends respectively of a glass or quartz optical fiber rod, and whereby said replications to said beam are caused by an evanescent coupling effect occurring between said beam in said rod and said mixture of $CO_2$ and water vapor.

11. An optical filter apparatus for replicating in a simulated solar terrestrial beam, the wavelength bands that are due to absorption of sunlight by atmospheric $CO_2$ and water vapor, said apparatus including:

a. means for generating and heating a gaseous stream comprising a mixture of $CO_2$ and water vapor whereby said mixture has a relative humidity of at least 90% and a temperature of about 90° C.;

b. a chamber having a cavity for receiving said gaseous mixture, and an inlet for said mixture and an outlet for said mixture, said inlet connected in flow communication with said means for generating and heating said gaseous stream, said chamber having an optical inlet and an optical outlet; and c. means for heating said chamber whereby said mixture in said cavity can be maintained at said relative humidity and temperature, and whereby said chamber provides an optical path for said beam, from said optical inlet to said optical outlet.

12. Apparatus as defined in claim 11 wherein said optical path is a direct one and no greater that 1 meter in length.

13. Apparatus as defined in claim 11 including reflective means mounted in said chamber for receiving said beam that enters said chamber through said optical inlet, and for reflecting said beam to said optical outlet.

14. Apparatus as defined in claim 13 wherein said reflective means includes a plurality of mirrors that are arranged to provide said path with a plurality of reflections.

15. Apparatus as defined in claim 14 wherein said chamber has a given length, and said beam path is a plurality of times greater than said chamber length.

16. Apparatus as defined in claim 14 wherein at least one of said mirrors is concave.

17. Apparatus as defined in claim 13 wherein said optical outlet comprises a convex lens.

18. Apparatus as defined in claim 12 wherein said cavity is bounded by a spherical reflective surface and said reflective means is oriented to reflect an input beam through said optical inlet to said spherical surface, whereby a plurality of reflections of said beam are produced within said cavity, and wherein said optical outlet comprises a convex lens.

19. Apparatus as defined in claim 18 wherein said optical inlet is a convex lens.

20. Apparatus as defined in claim 18 wherein said chamber inlet for said mixture has a portion that extends radially inwardly of said cavity, and has an inner end that supports said reflective means.

21. Apparatus as defined in claim 18 wherein said reflective means comprises a concave mirror.

22. Apparatus as defined in claim 18 wherein the diameter of said spherical surface is less than 20 cm.

23. Apparatus as defined in claim 11 including an optical fiber rod mounted in said chamber, said rod having a first end that comprises said optical inlet, and having an opposite end that comprises said optical outlet, and wherein a light beam through said rod undergoes evanescent coupling with said $CO_2$ and water vapor mixture.

* * * * *